United States Patent [19]

Byrnes et al.

[11] Patent Number: 4,655,853

[45] Date of Patent: Apr. 7, 1987

[54] METHOD FOR MAKING POWDER METAL FORGING PREFORMS OF HIGH-STRENGTH FERROUS-BASE ALLOYS

[75] Inventors: Larry E. Byrnes, Brighton; Jon T. Gabrielsen, Ann Arbor, both of Mich.

[73] Assignee: Federal-Mogul Corporation, Southfield, Mich.

[21] Appl. No.: 724,498

[22] Filed: Apr. 18, 1985

Related U.S. Application Data

[63] Continuation of Ser. No. 406,658, Aug. 9, 1982, abandoned.

[51] Int. Cl.[4] ..... B22F 3/00

[52] U.S. Cl. ..... 148/16.5; 148/16.7; 419/25; 419/59

[58] Field of Search ..... 148/16.5, 16.7, 153; 266/257; 419/25, 59

[56] References Cited

U.S. PATENT DOCUMENTS

| | | | |
|---|---|---|---|
| 2,637,671 | 5/1953 | Pavitt | 148/153 |
| 3,598,381 | 8/1971 | Schwalm | 148/16.5 |
| 3,992,763 | 11/1976 | Haynie et al. | 148/16.5 |
| 4,139,375 | 2/1979 | Solomon et al. | 419/59 |
| 4,266,974 | 5/1981 | Nitta et al. | 75/123 J |

FOREIGN PATENT DOCUMENTS

| | | | |
|---|---|---|---|
| 6624 | 3/1978 | Japan | 148/16.5 |
| 34647 | 3/1980 | Japan | 419/25 |
| 29667 | 3/1981 | Japan | 148/16.5 |

*Primary Examiner*—Christopher W. Brody

*Attorney, Agent, or Firm*—Robert F. Hess; Lawrence J. Shurupoff

[57] ABSTRACT

The invention involves a method for making powder metal forging preforms of high strength ferrous-base alloys in which the times and temperatures for reducing oxides, sintering, and carburizing are substantially reduced as compared to conventional techniques. The method includes simultaneously sintering and carburizing the preforms in the hot zone of a sintering furnace at temperatures below 2000° F. and for a period of time above austenitic temperature not exceeding about 35 minutes. After carburizing the preforms are rapidly cooled to freeze the case carbon gradient obtained in the hot zone.

10 Claims, 5 Drawing Figures

METHOD FOR MAKING POWDER METAL FORGING PREFORMS OF HIGH-STRENGTH FERROUS-BASE ALLOYS

This application is a continuation, of application Ser. No. 406,658, filed Aug. 9, 1982 now abandoned.

BACKGROUND OF THE INVENTION

This invention relates to a method for reducing, sintering and carburizing pre-alloyed, ferrous-base powder metal forging preforms.

The invention provides a method for making powder metal forging preforms of high strength ferrous-base alloys in which the times and temperatures for reducing, sintering and carburizing such preforms are substantially reduced. Additionally, the method produces forging preforms having an improved carbon gradient over forging preforms produced by current methods.

In the production of high strength, ferrous-base powder metal parts, pre-alloyed powder is cold pressed, sintered, and then forged. During sintering, oxides in the powder are reduced to acceptable levels. For parts which require case carburizing, it has been found advantageous to carburize the part prior to forging, preferably in the sintering furnace. Consequently, the sintering furnace produces an in-process product which may be described as a sintered and carburized forging preform. This forging preform is lubricated, heated to an appropriate forging temperature, and forged to a close tolerance configuration. After forging, the part is normally quenched and stress relieved.

A number of powder metal parts require a post forging machining operation, such as grinding. In such cases, it is necessary to insure that the carbon case introduced during carburizing has adequate depth and composition to permit the removal of material during machining while maintaining the specified surface carbon content. The carbon gradient produced by current powder metallurgy techniques has not been adequate for certain applications in which relatively high post-machining surface carbon is required.

In addition to the physical properties of forged powder metal parts, another important consideration is cost. The growth in the popularity of powder metal parts has been due, in many cases, to lower manufacturing costs as compared to the more conventionally manufactured products, such as machined-from-wrought parts. In other words, while it is recognized that powder metal and machine parts are, in many instances, comparable in physical properties, powder metal parts have been able to replace or compete with machined parts due to lower manufacturing costs. While lower manufacturing costs are generally the case, the difference in cost between powder metal and machined parts for higher strength applications, such as components for transmissions and axles, is smaller. This narrowing of the cost advantage is due, in part, to the more sophisticated process used to manufacture forged powder metal parts. Consequently, competition between forged powder metal parts and machined parts for these applications is severe. Improvements which lower the cost of manufacturing forged powder metal parts are quite important to enable these products successfully to compete with machined products.

SUMMARY OF THE INVENTION

This invention involves an improved process for producing forging preforms, that is, a powder metal part which has been cold pressed, sintered, and carburized, in preparation for the forging step. In one embodiment of the invention the process produces a forging preform having an acceptable carbon gradient, but at times and temperatures substantially below those generally recognized as necessary to do so. In this regard, it is pointed out that the invention is directed to hardenable alloy steels which contain one or more alloying additions of molybdenum, nickel, manganese, chromium and the like. Carburized forging preforms have been produced by this process from pre-alloyed powder similar in composition to the AISI 4600 series steel at temperatures below 2000° F. with a total time in the austenitic temperature range of about 35 minutes or less. The AISI 3600 series steel alloy is commonly known to have alloying additions of 1.55 or 1.80 weight percent nickel and 0.20 or 0.25 weight percent molybdenum, as published in the Making, Shaping and Treating of Steel, Ninth Edition, published by the United States Steel Corporation, 1971. In addition to producing an adequate carbon case, the process is capable of reducing oxides to acceptable levels, that is, less than 1,000 $O_2$. This is contrasted with current sintering/carburizing processes for comparable alloys which are conducted at 2050° F. and with times above the austenitic formation temperature of approximately 60 minutes. Consequently, the cost of producing forging preforms is substantially reduced because production time is substantially reduced and energy requirements are reduced.

In another embodiment of the invention, the process includes a step for modifying the carbon gradient to produce an improved forging preform for applications which require a relatively high surface carbon content after machining. The carbon gradient is modified to produce a plateau having a depth of at least 0.010 inches over which the carbon content decreases by no more than about 0.10%. (Compositions are given throughout in weight percent.) This carbon gradient permits the removal of up to about 0.010 inches of stock during machining without reducing the surface carbon content below an acceptable level. This feature of the invention appears to be particularly important in the production of races for antifriction bearings from powder metal since these races have ground surfaces which require relatively high postgrinding surface hardness.

The sintering/carburizing process according to the invention is conducted in a fairly conventional belt-type sintering furnace which includes a preheat zone, a hot zone, and a cooling zone. Sintering and carburizing are performed simultaneoulsy in the hot zone. A short diffusion zone may be added immediately following the hot zone when it is desired to modify the carbon gradient from that which is obtained during primary carburization in the hot zone.

In the preheat zone the cold pressed preform is heated to burn off lubricants, such as zinc stearate, stearic acid, and waxes, the conventional function of the preheat zone.

Contrary to conventional practice, the preheat zone is maintained at a temperature significantly higher than usual to rapidly heat the preform to a predetermined sintering/carburizing temperature. More specifically, while the preheat zone in conventional pracice is typically heated to temperatures up to 1500° F., temperatures as high as 2000° F. could be employed in accordance with this invention. It should be noted, however, that the temperature of the preheat zone is determined in light of the process temperature. Hence, if the sintering/carburizing temperature is lowered to 1750° F., the temperature in the preheat zone would also be lowered. The time in the preheat zone is also reduced. While conventional sintering practice specifies a time in the preheat zone of about 15 to 30 minutes, the time in the preheat zone according to the instant invention is 10 minutes or less.

After preheating, the preform moves into the hot zone in which it is simultaneoulsy sintered and carburized. The hot zone is maintained at a temperature below 2000° F. which is at least 50° F. below temperatures normally recommended for prealloyed powders of this type. An atmosphere having a high carbon potential is used in the hot zone, that is, an atmosphere having a carbon potential which is higher than the desired surface carbon content. The preform is maintained in the hot zone for approximately 20 minutes.

In one embodiment of the invention the preform is moved from the hot zone into a first cooling zone in which the preform is rapidly cooled (within approximately five minutes) to begin the austenitic to martensitic transformation to freeze the case carbon gradient obtained during carburization. The preform is then cooled in a second cooling zone to a temperature below about 500° F. to prevent detrimental oxidation.

In another embodiment of the invention the preform is moved from the hot zone into a diffusion zone for modifying the shape of the carbon gradient obtained in the hot zone. The diffusion zone is heated by the product moving through the zone so that the temperature upon entry is approximately equal to the temperature of the hot zone. The diffusion zone is insulated so that the temperature of the preform does not fall below the austenitic transformation temperature. A carburizing atmosphere of a desired carbon potential is maintained in the diffusion zone. The atmosphere is controlled independently from the atmosphere in the sintering-/carburizing zone and has a carbon potential which is below the carbon potential of the hot zone and is at, or slightly below, the desired surface carbon content of the preform. The preform is maintained in the diffusion zone for up to about five minutes to change the carbon gradient to one with a plateau which extends to a depth of at least 0.010 inches with no more than about a 0.10% decrease in carbon content. The preform is then rapidly cooled in the first cooling zone to begin the austenitic to martensitic transformation and thereby freeze the carbon gradient in the case. Thereafter the preform is moved through the second cooling zone under conditions similar to those described with respect to the first embodiment.

DESCRIPTION OF THE PREFERRED EMBODIMENT

The concept of reducing both time and temperature in a sintering/carburizing process is contrary to conventional metallurgical principles. Time and temperature are considered to be inversely related with respect to sintering and carburizing processes. That is, if the temperature is reduced, the time must be increased, and vice versa.

Studies by the inventors have indicated that this rule, while applying to the carburization of wrought material, does not apply over all temperature ranges to the carburization of cold-pressed powder metal compacts. The inventors have discovered that the diffusion rate of carbon in the powder metal preform does not increase, but is fairly constant over the temperature range 1550° F. to 1950° F. Moreover, and more significantly, the diffusion rate is substantially higher in the powder metal preform over this temperature range than the diffusion rate in wrought material. At temperatures above 1950° F. the rate of diffusion begins increasingly rapidly and beyond 2000° F. the rates of diffusion become approximately equal for both materials so the advantage attained at lower temperatures is lost. Therefore, the isntant invention is designed to operate over the temperature range of about 1550° F. to about 1950° F.

Figure 1:
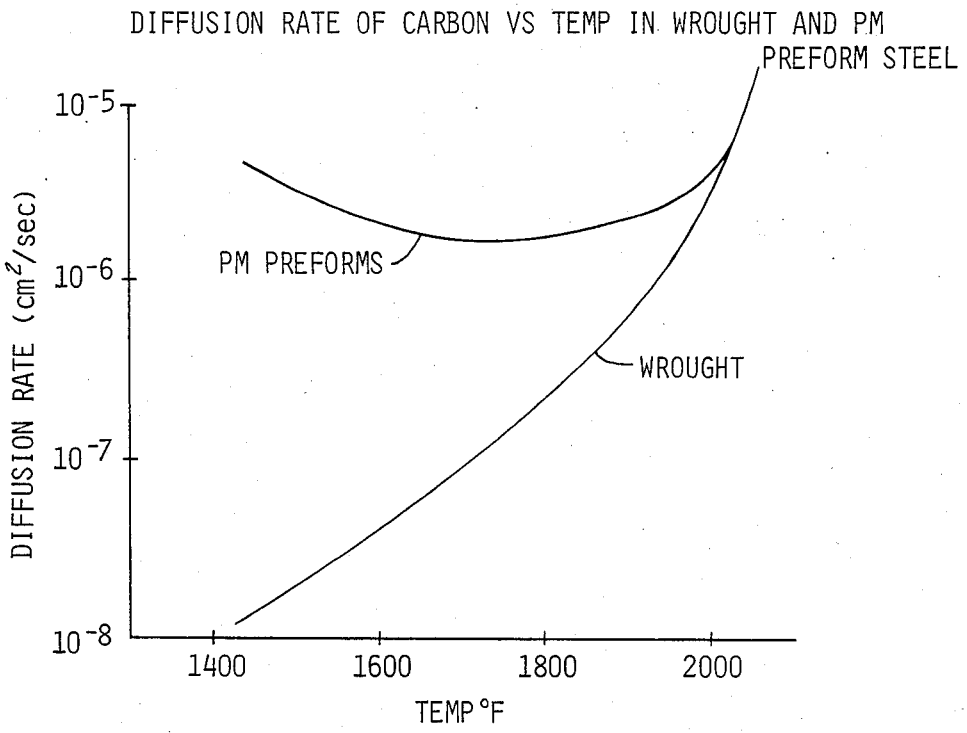
FIG. 1 is a graph showing the change in diffusion rate of carbon in wrought and powder metal preforms over the temperature range 1400°-2000° F.

The results of these studies are summarized in FIG. 1 which shows the rate of diffusion of carbon in powder metal and wrought material as a function of temperature. While the rate of diffusion in wrought material is very dependent on temperature, as is expected, the rate of diffusion in powder metal is nearly insensitive to temperature over the temperature range 1550° F.-1950° F. Moreover, the diffusion rate in the powder metal preform is substantially higher over this temperature range than in the wrought material. Above 1950° F. the rate of diffusion in powder metal seems to behave similarly to that in wrought material.

The phenomenon illustrated in FIG. 1 relaxes some significant restrictions on the sintering/carburizing process. The temperature can be reduced without causing a serious drop in the diffusion rate. Moreover, since relatively high rates of diffusion can be achieved, the time for carburization can be reduced. The time and temperature for the process can then be established based solely on the two remaining objectives of the process, reduction of oxides and adequate sintering.

Due to recent improvements in the manufacture of ferrous-base, pre-alloyed powders, oxide levels have been substantially reduced. If such improvements continue, it is quite likely that the oxide level can be reduced below the maximum level specified for forged powder metal parts, that is, below 1000 ppm $O_2$. When this occurs, the reduction of oxides can also be ignored. In the meantime, a temperature is selected which, in conjunction with a reducing atmosphere, is capable of reducing oxides to the required levels. For example, at 1850° F. the oxides in the powder can be reduced to a level of about 900 ppm $O_2$ which is below the specified maximum. Time at temperature can also be shortened due to the improved powders which have lower oxide contents to begin with.

Based on the foregoing, it was recognized by the inventors that satisfactory forging preforms could be produced at lower temperatures and shorter times than accepted practice indicates. As a result, a new process for reducing, sintering and carburizing a ferrous-base forging preform was developed. This new process is capable of producing forging preforms in markedly shorter times and with lower energy requirements than heretofore known processes.

The furance employed in carrying out the process is, for the most part, a conventional, belt-type, continuous furnace typical of those used in the powder metal parts industry. Special modifications and features will be apparent from the more detailed description of the furnace which follows.

Figure 4:
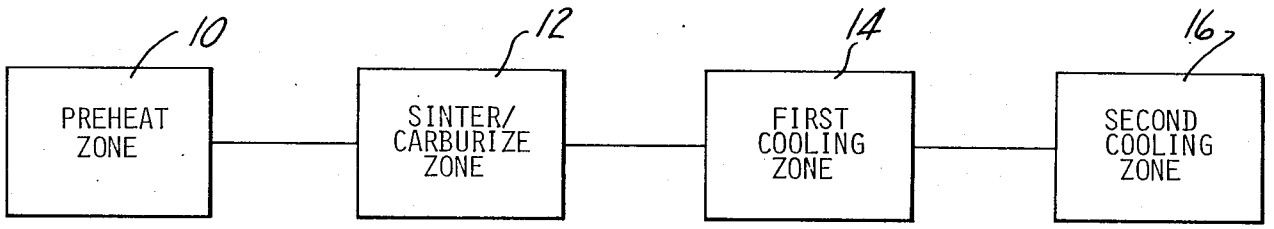
FIG. 4 is a flow chart of a first sintering/carburizing process in accordance with the instant invention.

According to one embodiment of the invention, the furnace is divided into four functional zones. With reference to the schematic shown in FIG. 4, these comprise a preheat zone 10, a sinter/carburize zone 12, a first cooling zone 14 and a second cooling zone 16. The furnace may be heated electrically or with gas and the work is moved through it on a continuous mesh belt. The furnace also has the necessary plumbing for maintaining a desired carburizing atmosphere in the sinter/-carburize zone 12. Other features of the furnace will be described in connection with the description of the process.

Pre-alloyed ferrous-base powder metal is first cold pressed into green forging preforms having a shape generally similar to the final forged part. This is done according to standard powder metallurgy practice and will not be described in greater detail. The pre-alloyed powder is one of the high strength ferrous-base alloys similar to AISI 4600 series with a predetermined base carbon content generally between 0.15 and 0.25% carbon. As previously noted, these powders include alloy additions which are believed to require high temperatures and relatively long process times. Preferably, the powder has the lowest oxide content economically attainable, currently 1500–2500 ppm $O_2$. The cold-pressed briquette typically has a density of 6.2–6.8 g/cm$^3$.

The green forging preforms are loaded onto the charge end of the furnace and are conveyed into the preheat zone 10. In the preheat zone waxes and lubricants are burned out of the green preform. Additionally, the preform is heated rapidly to a temperature which at least approaches the sintering/carburizing temperature. For example, if a sintering/carburizing temperature of 1950° F. is selected, the preheat zone is heated to at least 1850° F. so that the temperature of the green preform is near this temperature by the time it traverses the preheat zone. A belt speed of at least 12 inches per minute is maintained so that each green preform resides in the preheat zone for a period no longer than about 10 minutes.

A high methane content is observed in the atmosphere of the preheat zone due to the hydrocarbons in the wax. Consequently, there is a tendency for carbon soot to collect on the heating elements. If electric heating elements are employed, the soot can eventually cause a short circuit. In order to relieve this problem, coated, silicon carbide heating elements (glo-bars) are used in the preheat zone. These heating elements are less susceptable to carbon penetration than conventional heating elements. As will be described, a high methane condition also exists in the sintering/carburizing zone so this type of heating element is used there as well.

After preheating, the forging preform is moved into the sinter/carburize zone 12. This zone is referred to as the "hot" zone in conventional sintering furnaces. In this zone the preform is sintered, carburized and reduced. A carburizing atmosphere, for example, an endothermic gas, is maintained at a carbon potential which is greater than the desired surface carbon content. It should be recognized, however, that other carburizing atmospheres can be used. For example, if a surface carbon content of 0.85%–1.00% C. is required, a carbon potential of up to the saturation level of carbon in austenite at the specified temperature is maintained in the sinter/carburize zone; e.g. approximately 1.9% at 1950° F. The carbon potential of the atmosphere can be controlled in a number of known manners including, for example, maintaining a constant analyzed methane level in the zone using infrared analyzers. Since sintering furnaces vary in design and operating characteristics, it may be necessary empirically to correlate methane level and carbon potential, however, once the relationship is established, it is quite easy to maintain the desired methane level using standard control equipment.

The temperature of the sinter/carburize zone 12 is maintained at a temperature below 2000° F., the upper limit. The lower limit for the temperature is determined in light of two main considerations: the sintered preform strength and the ability to reduce oxides to acceptable levels. Due to the oxide levels of currently available powders, the ability to reduce oxides is the more restrictive consideration. With currently available powders, temperatures below 1850° F. are not recommended. If a temperature of 1950° F. is selected to insure oxide reduction well below 1000 ppm $O_2$, preforms with adequate strength for subsequent forging are produced. However, as the oxide content of the powder is reduced in the starting powder, the preform strength limits will ultimately control the lower limit for temperature. In any event, from our studies we conclude that the optimum temperature range for the process is from about 1550° F.–1950° F.

The problem of sooting caused by the high methane content of the atmosphere is circumvented by using coated silicon carbide heating elements, as in the preheat zone. Another problem which must be addressed is atmosphere consistency. Due to the high carbon potential in the sintering/carburizing zone, it is difficult to maintain a consistent atmosphere throughout this zone. A consistent atmosphere is believed to be necessary to produce predictable carbon gradients. Therefore, it is further believed that this zone requires forced circulation to insure a consistent atmosphere. High temperature, water-cooled fans have been employed and were found suitable for forcing circulation and maintaining a consistent atmosphere.

The time period during which the forging preform resides in the sintering/carburizing zone is short compared to recognized practice. Since the belt speed is at least 12 inches per minute, the period of time in this zone is no longer than 20 minutes.

Figure 2:
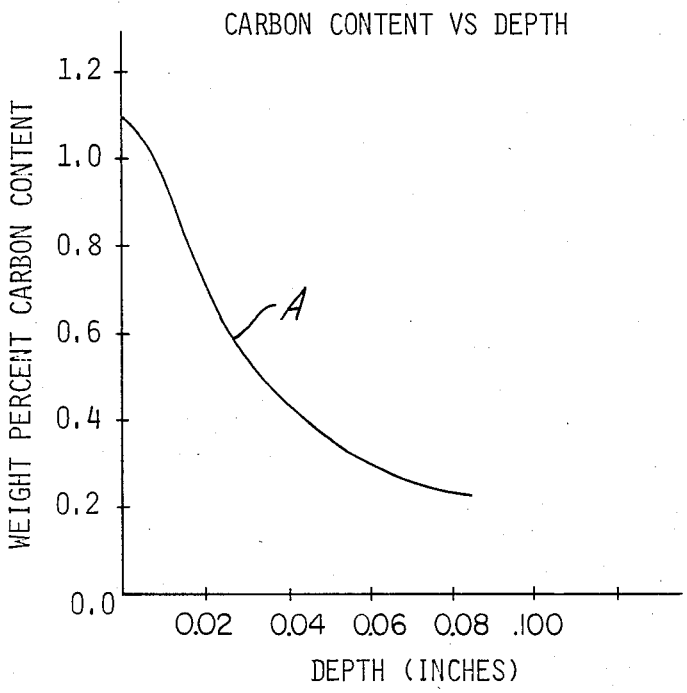
FIG. 2 is a graph showing the carbon gradient obtained in powder metal preforms according to the first embodiment of the invention.

Under the conditions described, a case carbon gradient is produced in the forging preform having a surface carbon content which is below the carbon potential of the atmosphere, but approximately equal to the desired surface carbon content. The carbon content decreases relatively constantly with distance from the surface to a depth of at least 0.020 inches after which the carbon content falls off less rapidly and non-linearly to the core carbon content. Curve A in FIG. 2 is characterstic of the shape of the carbon gradient produced in the sintering/carburizing zone.

In addition to carburizing the forging preform and reducing oxides, the preform is sintered. Although sintering is time and temperature dependant, it has been found that adequate strength can be imparted under the conditions described to produce an acceptable forging preform.

After the sinter/carburize zone, the preform is moved into a first cooling zone 14 in which it is rapidly cooled to begin the austenitic to martensitic transformation to fix, or freeze, the carbon gradient obtained in the hot zone. To obtain the desired carbon gradient, the temperature in the carbon case of the preform must be reduced to a tempeature below the austenitic to martensitic transformation temperature within a period of no longer than approximately five minutes. This is achieved by providing a water jacket around the first cooling section. At a belt speed of 12 inches per minute, the water jacket provides enough cooling to reduce the temperature below the austenitic transformation temperature within the first five feet of this section. In this embodiment of the invention, the atmosphere is not separately controlled, but consists of the atmosphere which flows from the sinter/carburize zone. Once the carbon gradient is fixed, the preform can be cooled at any rate to a desired exit temperature.

After the first cooling zone the forging preform is moved into a second cooling zone 16. The second cooling zone 16 comprises successively the remainder of the water jacketed section, a forced circulation section and another water jacketed section. In the second cooling zone the preform is gradually cooled to a temperature below about 500° F. If the forging preform is exposed to an oxidizing atmosphere at a temperature above about 500° F., unacceptable oxidation and scaling will occur.

At a belt speed of 12 inches per minute forging preforms are produced by the described process in approximately 87 minutes or less. Since faster belt speeds have been used under similar conditions, it is possible to reduce the time of production even more. Belt speeds of over 12 inches per minute have been used successively. It is believed that belt speeds of up to 24 inches per minute can be achieved. Forging preforms made in accordance with the invention have been subsequently forged with excellent success.

Figure 5:
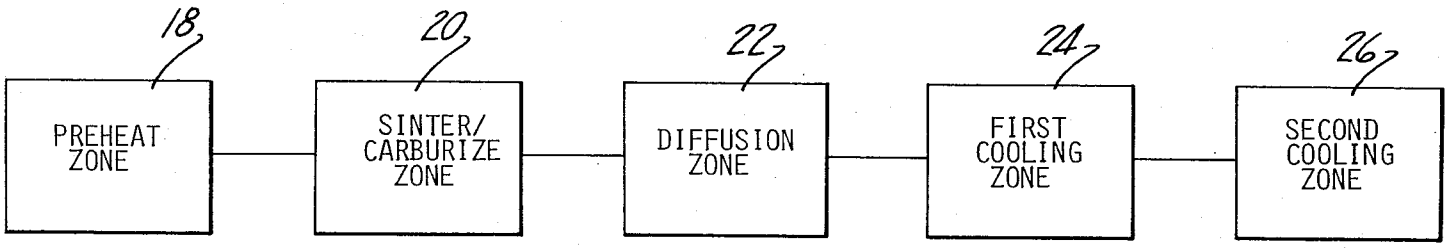
FIG. 5 is a flow chart of a second sinter/carburizing process in accordance with the instant invention.

In another embodiment of the invention, and with reference to FIG. 5, a diffusion zone 22 is added between the sinter/carburize zone 20 and the first cooling zone 24. The remainder of the furnace is the same as the one described with respect to the first embodiment, that is, it also includes a preheat zone 18 and a second cooling zone 26. The manner in which the preforms are processed is also the same through the sinter/carburize zone so the description will not be repeated. The diffusion zone 22 is used to modify the carbon gradient obtained in the sintering/carburizing zone 20 by forming a plateau which extends to a depth of at least 0.01 inches. This plateau produces a case of high carbon which is deep enough to permit surface grinding to a depth of 0.01 inches while maintaining the required surface carbon content and, hence, the required surface hardness.

The diffusion zone 22 comprises a furnace section which is insulated to prevent heat loss. It is similar in construction to the buffer zone commonly used in sintering furnace design. However, unlike conventional sintering furnace design, the diffusion zone includes means for controlling the atmosphere. The atmosphere in the diffusion zone is controlled to produce a carbon potential at or slightly below the desired surface carbon content. Typically the carbon potential of the atmosphere in the diffusion zone is lower than the carbon potential of the atmoshpere in the sintering/carburizing zone. In tests conducted using forging preforms made of a pre-alloyed powder similar to AISI 4618 alloy steel, the carbon potential of the sinter/carburize zone was established to produce a surface carbon content of over 1.2% carbon. The atmosphere in the diffusion zone 22 was controlled to produce a final carbon content at the surface of between 1.00% and 1.10% carbon.

Figure 3:
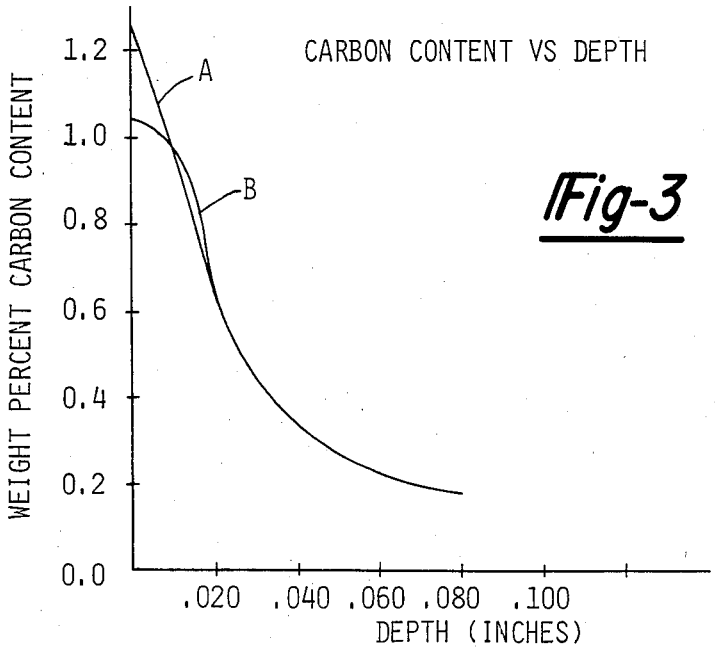
FIG. 3 is a graph showing the carbon gradient obtained in powder metal preforms according to the second embodiment of the invention.

FIG. 3 is a graph showing carbon content as a function of depth in a preform. Curve A is typical of the carbon gradient produced in the sinter/carburize zone of the furnace. That is, the carbon content decreases relatively constantly to a depth of approximately 0.020 inches from the surface of the preform after which the carbon content decreases nonlinearly toward the core carbon content.

In the diffusion zone the carbon gradient is modified to produce a plateau having at the surface of the preform the desired carbon content and extending to a depth of approximately 0.01 inches with no more than about a ten point (0.1%) decrease in carbon content. A typical carbon gradient produced in the diffusion zone is illustrated by Curve B of FIG. 3. This carbon gradient profile is more acceptable for certain forged parts which must be machined, e.g., ground after forging.

After moving through the diffusion zone 22, the preform enters the first cooling zone 24 in which at least the carbon case is cooled to a temperature below the austenitic transformation temperature within a period of no longer than about five minutes to freeze the case carbon gradient. The preform is then further cooled in the second cooling zone 26 for a period of twenty to twenty-five minutes to a temperature below about 500° F.

In summary, the invention provides a significantly improved process for producing powder metal forging preforms. The invention permits such preforms to be produced at times and temperatures substantially below those currently employed and, therefore, reduces the cost of production. However, in one embodiment of the invention, an improved carbon gradient is produced in the preform which facilitates subsequent machining of the preform.

The invention has been described in an illustrative manner and it is to be understood that the terminology which has been used is intended to be the nature of words of description rather than limitation. Modifications and variations of the present invention are possible in light of the teachings contained herein. It is therefore to be understood that the invention may be practiced otherwise than as specifically described herein and yet remain within the scope of the appended claims.

The invention for which an exclusive claim or privilege is sought is:

I claim:

1. A method for simultaneously sintering and carburizing a pre-alloyed, ferrous-base, powder metal forging preform characterized by the steps of:

providing a porous preform comprised of a type AISI 4600 series steel alloy comprising a base carbon content between 0.15 and 0.25 weight percent, said preform having a density of at least about 6.2 gm/cm$^3$, preheating the preform in the preheat zone of a continuous furnace for a period of no more than about 10 minutes and substantially no longer than is required to burn off lubricants and to induce rapid heating of the preform to a temperature in the austenitic range which approaches sintering/carburizing temperature, simultaneously sintering and carburizing the preform in the hot zone of the furnace in a carburizing atmosphere having a carbon potential greater than the desired surface carbon content (i) at a temperature substantially within the range of about 1550° F. to below 2000° F. and above the solubility temperature of carbon in austenitic iron, (ii) at the carbon potential of the atmosphere and (iii) for a period of time sufficient to reduce oxides to a level less than 1000 ppm $O_2$ and to produce a final case carbon gradient in the preform which begins at a surface carbon content approximately equal to the desired case carbon content and decreases relatively constantly to a depth of about 0.020 inches, cooling the preform in a first cooling zone of the furnace at a rate rapid enough to begin transformation of the austenitic phase in the case thereby freezing the final case carbon gradient at levels obtained at the end of the hot zone of the furnace, controlling the total time that the preform is at temperatures in the austenitic temperature range to 35 minutes or less, and further cooling the preform in a second cooling zone of the furnace to a temperature below about 500° F., whereby a sintered and case carburized preform is produced in minimum time at temperatures above the austenitic temperature and at a maximum temperature less than about 2000° F.

2. A method for simultaneously sintering and carburizing a pre-alloyed, ferrous-base, powder metal forging preform characterized by the steps of:

providing a porous preform comprised of a high strength, hardenable, ferrous-base alloy having a base carbon content of up to about 0.25 percent by weight and at least one alloying addition of molybdenum, nickel, manganese or chromium, said preform having a density between about 6.2 to about 6.8 gm/cm$^3$, preheating the preform in the preheat zone of a continuous furnace for a period no longer than about 10 minutes to burn off lubricants and to induce rapid heating of the preform to a temperature in the austenitic range which approaches sintering/carburizing temperature, simultaneously sintering and carburizing the preform in the hot zone of the furnace in a carburizing atmosphere having a carbon potential greater than the desired surface carbon content (i) for a period no longer than 20 minutes, (ii) at a temperature substantially within the range of about 1550° F. and about 1950° F. and above the solubility temperature of carbon in austenitic iron, and (iii) at a carbon potential substantially equalling the saturation level of carbon in austenitic at the prevailing sintering/carburizing temperature to reduce oxides and to produce a case carbon gradient in the preform having a surface carbon content approximately equal to the desired case carbon content and decreasing relatively constantly to a depth of about 0.020 inches, cooling the preform in a first cooling zone of the furnace for a period of approximately five minutes at a rate rapid enough to begin transformation of the austenitic phase in the case thereby freezing the case carbon gradient, and further cooling the preform in a second cooling zone of the furnace to a temperature below about 500° F., whereby a sintered and case carburized preform is produced with total time at temperature above the austenitic temperature of 35 minutes or less and at a maximum temperature less than 1950° F.

3. The method set forth in claim 2 wherein the step of sintering and carburizing is further characterized by forcing the circulation of the atmosphere.

4. A method for simultaneously sintering and carburizing a pre-alloyed, ferrous-base, powder metal forging preform characterized by the steps of:

providing a porous preform comprised of a high-strength, hardenable, ferrous-base alloy having a base carbon content of 0.15 to 0.25 percent by weight and at least one alloying addition of molybdenum, nickel, manganese or chromium, said preform having a density of at least about 6.2 gm/cm$^3$, preheating the preform in the preheat zone of a continuous furnace for a period no longer than is required to burn off lubricants and to induce rapid heating of the preform to a temperature in the austenitic range which approaches sintering/carburizing temperature, simultaneously sintering and carburizing the perform in the hot zone of the furnace in a carburizing atmosphere having a carbon potential greater than the desired surface carbon content (i) at a temperature substantially within the range of about 1550° F. to below 2000° F. and above the solubility temperature of carbon in austenitic iron, (ii) at the carbon potential of the atmosphere and (iii) for a period of time sufficient to reduce oxides to a level less than 1000 ppm $O_2$ and to produce a case carbon gradient in the preform which begins at a surface carbon content approximately equal to the desired case carbon content and decreases relatively constantly to a depth of about 0.020 inches, modifying the carbon gradient in a diffusion zone of the furnace having a temperature approximately equal to the temperature of the hot zone on entry and decreasing with distance from the hot zone to a temperature not below the austenitic temperature in a carburizing atmosphere having a carbon potential at or below the desired surface carbon content for a period of time sufficient to produce a final case carbon gradient with a carbon plateau having at the surface of the preform the desired carbon content and extending to a depth of approximately 0.01 inches with no more than about a ten point (0.10%) decrease in carbon content, controlling the total time that the preform is at temperatures above the austenitic temperature to 35 minutes or less.

cooling the preform in a first cooling zone of the furnace at a rate rapid enough to transform the austenitic phase to a martensitic phase in the case thereby freezing the final carbon gradient at the levels of said carbon plateau, and further cooling the preform in a second cooling zone of the furnace to a temperature below about 500° F.

5. A method for simultaneously sintering and carburizing a pre-alloyed, ferrous-base, powder metal forging preform characterized by the steps of:

providing a porous preform comprised of a high-strength, hardenable, ferrous-base alloy having a base carbon content of 0.15 to 0.25 percent by weight and at least one alloying addition of molybdenum, nickel, manganese or chromium, said preform having a density between about 6.2 to about 6.8 gm/cm$^3$, preheating the preform in the preheat zone of a continuous furnace for a period no longer than about 10 minutes to burn off lubricants and to induce rapid heating of the preform to a sintering-/carburizing temperature, simultaneously sintering and carburizing the preform in the hot zone of the furnace in a carburizing atmosphere having a carbon potential greater than the desired surface carbon conent for a period no longer than 20 minutes and at a temperature substantially within the range of about 1550° F. to about 1950° F. and above the solubility temperature of carbon in austenitic iron at the carbon potential of the atmosphere to reduce oxides and to produce a carbon gradient in the preform having a surface carbon content greater than the desired case carbon content and which decreases relatively constantly to a depth of about 0.020 inches, modifying the carbon gradient in a diffusion zone of the furnace having a temperature approximately equal to the temperature of the hot zone on entry and decreasing with distance from the hot zone to a temperature not below the austenitic temperature for a period of up to about five minutes in a carburizing atmosphere having a carbon potential at or below the desired surface carbon content to produce a carbon plateau having at the surface of the preform the desired carbon content and extending to a depth of approximately 0.01 inches with no more than about a ten point (0.10%) decrease in carbon content.

cooling the preform in a first cooling zone of the furnace for a period of approximately five minutes at a rate rapid enough to transform the austenitic phase to a martensitic phase thereby freezing the carbon gradient, and further cooling the preform in a second cooling zone of the furnace to a temperature below about 500° F.

6. The method as set forth in claim 5 wherein the step of sintering and carburizing is further characterized by forcing circulation of the atmosphere.

7. The method set forth in claim 2 in which said carburizing atmosphere is maintained at a carbon potential of up to the saturation level of carbon in austenite at the prevailing sintering/carburizing temperature.

8. The method set forth in claim 4 in which said carburizing atmosphere is maintained at a carbon potential of up to the saturization level of carbon in austenite at the prevailing sintering/carburizing temperature.

9. The method of claim 2 in which said ferrous base alloy is an AISI 4600 series type steel alloy.

10. A method for simultaneously sintering and carburizing a pre-alloyed, ferrous-base, powder metal forging preform characterized by the steps of:

providing a porous comprised of a type AISI 4600 series steel alloy comprising a base carbon content between 0.15 and 0.25 weight percent, said preform having a density of at least about 6.2 gm/cm$^3$, preheating the preform in the preheat zone of a continuous furnace for a period substantially no longer than is required to burn off lubricants and to induce rapid heating of the preform to a temperature in the austenitic range which approaches sintering/carburizing temperature, simultaneously sintering and carburizing the preform in the hot zone of the furnace in a carburizing atmosphere having a carbon potential greater than the desired surface carbon content (i) at a temperature substantially within the range of about 1550° F. to about 1950° F. and above the solubility temperature of carbon in austenitic iron, (ii) at the carbon potential of the atmosphere and (iii) for a period no longer than 20 minutes and sufficient to reduce oxides to a level less than 1000 ppm $O_2$ and to produce a final case carbon gradient in the preform which begins at a surface carbon content approximately equal to the desired case carbon content and decreases relatively constantly to a depth of about 0.020 inches, cooling the preform in a first cooling zone of the furnace at a rate rapid enough to begin transformation of the austenitic phase in the case thereby freezing the final case carbon gradient at levels obtained at the end of the hot zone of the furnace, controlling the total time that the preform is at temperatures in the austenitic temperature range to 35 minutes or less, and further cooling the preform in a second cooling zone of the furnace to a temperature below about 500° F., whereby a sintered and case carburized preform is produced in minimum time at temperature above the austenitic temperature and at a maximum temperature less than about 2000° F.

* * * * *